US012507791B2

(12) United States Patent
Tanaka

(10) Patent No.: US 12,507,791 B2
(45) Date of Patent: Dec. 30, 2025

(54) COSMETIC APPLICATOR

(71) Applicant: SINWA CORPORATION, Yokohama (JP)

(72) Inventor: Akihiro Tanaka, Yokohama (JP)

(73) Assignee: SINWA CORPORATION, Yokohama (JP)

( * ) Notice: Subject to any disclaimer, the term of this patent is extended or adjusted under 35 U.S.C. 154(b) by 264 days.

(21) Appl. No.: 18/025,526

(22) PCT Filed: Sep. 10, 2020

(86) PCT No.: PCT/JP2020/034274
§ 371 (c)(1),
(2) Date: Mar. 9, 2023

(87) PCT Pub. No.: WO2022/054196
PCT Pub. Date: Mar. 17, 2022

(65) Prior Publication Data

US 2024/0008632 A1 Jan. 11, 2024

(51) Int. Cl.
*A46B 9/02* (2006.01)
*A45D 34/04* (2006.01)

(52) U.S. Cl.
CPC ..... *A46B 9/021* (2013.01); *A45D 34/042* (2013.01); *A46B 2200/106* (2013.01)

(58) Field of Classification Search
CPC ..... A46B 9/021; A46B 9/06; A46B 2200/106; A46B 2200/1046; A46B 2200/1053;
(Continued)

(56) References Cited

U.S. PATENT DOCUMENTS 4,344,202 A * 8/1982 Hayat ..... A61C 17/3472 15/23
7,089,946 B2 * 8/2006 Rousselet ..... A46B 3/18 132/218

(Continued)

FOREIGN PATENT DOCUMENTS

JP 2004-329946 A 11/2004
JP 2007-050183 A 3/2007

(Continued)

OTHER PUBLICATIONS

Clarivate Analytics copyrighted translation of JP2007050183A; publication date Mar. 1, 2007 (Year: 2007).*

(Continued)

*Primary Examiner* — Thomas C Barrett
*Assistant Examiner* — Sarah Woodhouse
(74) *Attorney, Agent, or Firm* — Studebaker Brackett PLLC

(57) ABSTRACT

The cosmetic applicator includes an applying portion in which a comb member including comb teeth provided on a lower surface of a semi-cylindrical applicator body open upward, and a brush member including a brush bristle body around a core wire stem, are integrated coaxially. In the applying portion, tip ends of brush bristles of the brush bristle body are flush with and in contact with an inner circumferential surface of the body, a core wire stem front end portion engages with a bearing open downward at a front end side of the body, a core wire stem rear end portion is fixed to a bearing open upward at a rear end side of the body, and accordingly, the brush member is cantilevered on the comb member.

7 Claims, 4 Drawing Sheets

(58) Field of Classification Search
CPC .. A45D 34/043; A45D 34/042; A45D 34/045; A45D 34/046; A45D 40/262; A45D 40/265; A45D 40/264; A45D 40/267; A45D 2200/25
See application file for complete search history.

(56) References Cited

U.S. PATENT DOCUMENTS

| | | | | |
|---|---|---|---|---|
| 2004/0221865 | A1* | 11/2004 | Kim | A46B 3/18 132/218 |
| 2009/0276973 | A1* | 11/2009 | Bouix | A46B 9/021 15/207.2 |
| 2011/0048448 | A1* | 3/2011 | Legassie | A45D 40/267 401/122 |
| 2017/0347776 | A1* | 12/2017 | Jacob | A46B 9/028 |
| 2017/0347784 | A1* | 12/2017 | Jacob | A46B 3/18 |
| 2020/0329847 | A1* | 10/2020 | Bianco | A45D 34/043 |
| 2020/0352308 | A1* | 11/2020 | Schreiber | A45D 40/262 |
| 2020/0383462 | A1* | 12/2020 | Leonard | A46B 9/021 |

FOREIGN PATENT DOCUMENTS

| | | | |
|---|---|---|---|
| JP | 2007-117368 | A | 5/2007 |
| JP | 2012-055492 | A | 3/2012 |

OTHER PUBLICATIONS

Clarivate Analytics copyrighted translation of JP2011156198A; publication date Aug. 18, 2011 (Year: 2011).*
Clarivate Analytics copyrighted translation of KR20180082839A; publication date Jul. 19, 2018 (Year: 2018).*
Clarivate Analytics copyrighted translation of JP2007117368A; publication date May 17, 2007 (Year: 2007).*
Clarivate Analytics copyrighted translation of KR20150017982A; publication date Feb. 23, 2015 (Year: 2015).*
Clarivate Analytics copyrighted translation of KR20100043533A; publication date Apr. 29, 2010 (Year: 2010).*
Clarivate Analytics copyrighted translation of KR20180086641A; publication date Aug. 1, 2018 (Year: 2018).*
Clarivate Analytics copyrighted translation of JPH0433790Y2; publication date Aug. 12, 1992 (Year: 1992).*
Clarivate Analytics copyrighted translation of KR200433657; publication date Dec. 12, 2006 (Year: 2006).*
Clarivate Analytics copyrighted translation of KR20180091501A; publication date Aug. 16, 2018 (Year: 2018).*
Clarivate Analytics copyrighted translation of JPH0433791Y2; publication date Aug. 12, 1992 (Year: 1992).*
Clarivate Analytics copyrighted translation of JP2015029752A; publication date Feb. 16, 2015 (Year: 2015).*
Clarivate Analytics copyrighted translation of KR20150001691U; publication date May 6, 2015 (Year: 2015).*
Clarivate Analytics copyrighted translation of JP6187848B2; publication date Aug. 30, 2017 (Year: 2017).*
Clarivate Analytics copyrighted translation of JP2012055492A; publication date Mar. 22, 2012 (Year: 2012).*
Clarivate Analytics copyrighted translation of KR20180018103A; publication date Feb. 21, 2018 (Year: 2018).*
Clarivate Analytics copyrighted translation of KR20160087201A; publication date Jul. 21, 2016 (Year: 2016).*
International Search Report issued in corresponding patent application No. PCT/JP2020/034274 on Oct. 20, 2020; 8 pages.

* cited by examiner

FIG. 2A
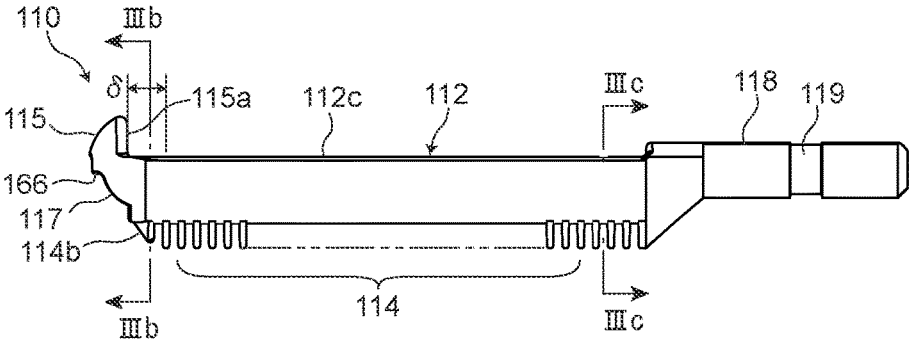
FIG. 2B
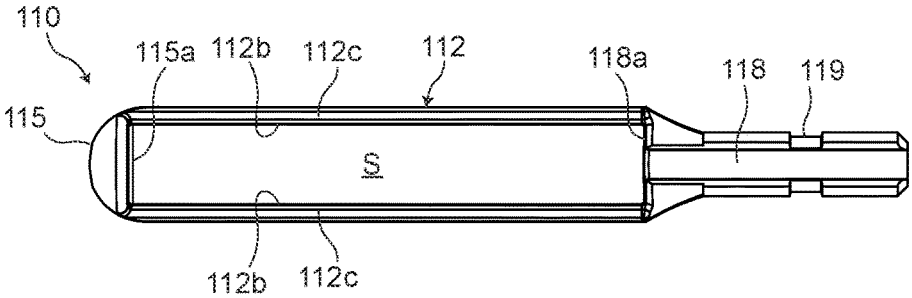
FIG. 2C
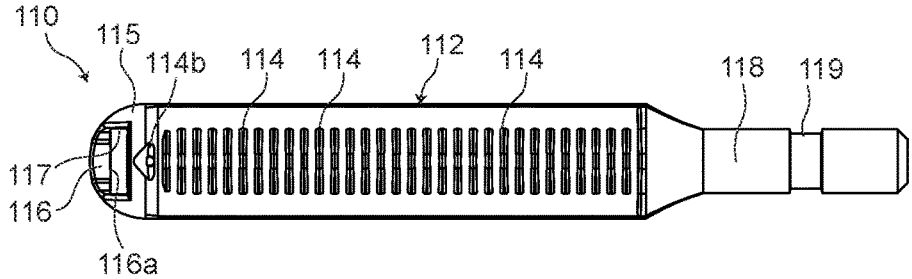
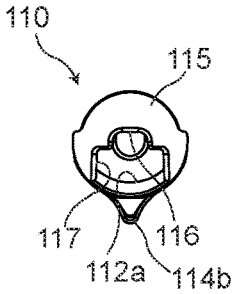
FIG. 2D
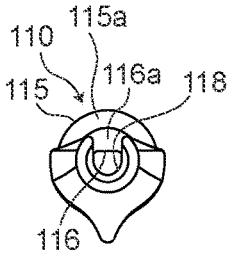
FIG. 2E

COSMETIC APPLICATOR

TECHNICAL FIELD

The present invention relates to a cosmetic applicator optimum for applying a cosmetic liquid such as a mascara liquid, specifically, to a cosmetic applicator including an applying portion formed by integrating a comb member and a brush member.

BACKGROUND ART

The patent literature listed below describes a cosmetic applicator including an applying portion formed by integrating a comb member 2 including comb teeth 14 continuous at equal intervals with a brush member 3 including a brush bristle body 22 in a columnar form surrounding a core member 21.

That is, comb teeth 14 are provided on a lower surface side of the applying portion extending in a front-rear direction, a brush bristle body 22 is provided on an upper surface side of the applying portion so as to be exposed, and while eyelashes are combed with the comb teeth 14 of the applying portion, a mascara liquid held in gaps between the comb teeth 14 can be attached to the eyelashes, and next, by combing the eyelashes with the brush bristle body 22 (brush bristle body 22 exposed to an opposite side of the comb teeth 14) on the upper surface side of the applying portion, eyelashes to which a mascara liquid attaches can be arranged.

Specifically, the comb member 2 includes an applicator body having a substantially semi-cylindrical shape open upward and long in the front-rear direction by forming the comb teeth 14 in the shapes of substantially U-shaped thin plates at equal intervals in the front-rear direction on lower sides of a pair of left and right beams 12A and 12B extending parallel in the front-rear direction, and integrally forming a hand-side joint portion 11 and a tip end side joint portion 13 having upstanding wall shapes at front and rear end portions of the pair of beams 12A and 12B. That is, the comb teeth 14 are formed on a lower surface side of the applicator body of the comb member 2.

Then, by fixing front and rear end portions of the core member 21 of the brush member 3 to the hand-side joint portion 11 and the tip end side joint portion 13 at the front and rear end portions of the applicator body (refer to Paragraph 0015 and FIGS. 1A, 1B, and 1C), an applying portion is configured in which the comb member 2 and the brush member 3 are integrated coaxially, and a substantially upper half region of the brush bristle body 22 of the brush member 3 accommodated in the applicator body is exposed from the applicator body.

CITATION LIST

Patent Literature

Patent Literature 1: Japanese Unexamined Patent Application Publication No. 2007-117368 (refer to Paragraphs 0008 to 0017 and FIGS. 1A, 1B, and 1C and 2A and 2B)

SUMMARY OF THE INVENTION

Problems to be Solved by the Invention

In the applying portion, by attaching and fixing the front and rear end portions of the core member 21 of the brush member 3 to attaching holes 90B respectively provided coaxially in the hand-side joint portion 11 and the tip end side joint portion 13 having upstanding wall shapes constituting the applicator body of the comb member 2 (refer to Paragraphs 0015 and 0087, and FIGS. 1A, 1B, and 10 and 19), the comb member 2 and the brush member 3 are fixed integrally. The applying portion is fitted in and fixed to a shaft (not illustrated) of a cap member through a center hole 10A of a joint portion 10 extending rearward from the hand-side joint portion 11 having an upstanding wall shape constituting the applicator body (refer to Paragraph 0017 and FIG. 1C).

Therefore, first, when injection-molding the comb member 2 with a pair of upper and lower molds that move in approaching and separating directions (up-down direction), the attaching holes 90B extending in the front-rear direction respectively provided in the hand-side joint portion 11 and the tip end side joint portion 13 having upstanding wall shapes constituting the applicator body of the comb member 2 constitute undercuts, so that in addition to the pair of upper and lower molds, split molds that move in the front-rear direction orthogonal to the up-down direction are required, and accordingly, the mold structure for injection-molding the comb member 2 becomes complicated, and this increases the manufacturing cost of the comb member and affects the price of the cosmetic applicator.

Second, an entire length of the brush member 3 is longer than a front-rear length of the inside of the applicator body (distance between the hand-side joint portion 11 and the tip end side joint portion 13), and the front and rear end portions of the core member 21 of the brush member 3 need to be attached (inserted) into the respective attaching holes 90B in a state where (the core member 21 of) the brush member 3 is bent (elastically deformed), so that this attaching (fitting) and fixing work is very troublesome. In particular, when the brush member 3 is bent over its elastic limit, plastic deformation remains on the core member 21 of the brush member 3, and causes a nonconforming product in which an external shape of the brush bristle body 22 exposed from the applicator body is not constant in the axial direction.

Therefore, in an applying portion configured so that a substantially upper half region of a brush bristle body accommodated in a substantially semi-cylindrical applicator body opens upward of the comb member and extending in the front-rear direction, is exposed above the applicator body by supporting core wire stem front and rear end portions of a brush member on bearings provided coaxially with the body at the respective front and rear end portions of the applicator body having comb teeth formed at equal intervals in the longitudinal direction and extending downward from the applicator body, as a structure that improves the first and second problems described above, the inventor conceived of a structure in which the bearing at the rear end side of the applicator body is formed to have a U-shaped cross section open upward, and the bearing at the front end side of the applicator body is formed to have a U-shaped cross section open downward, and in a state where a brush bristle body accommodated in the applicator body is flush with and in contact with an applicator body inner circumferential surface, the core wire stem rear end portion of the brush member is fixed to the bearing at the rear end side of the applicator body so that the brush member is cantilevered on the comb member.

Then, after making a trial product and verifying its effect, it was confirmed that the structure was effective, and accordingly, led to the present application.

The present invention was made in view of the above-described problems with the prior art, and an object thereof is to provide a cosmetic applicator including an applying portion configured so that a mold structure for molding a comb member constituting the applying portion is simple, and a brush member is easily fitted and fixed to the comb member.

Solution to Problems

In order to solve the first and second problems, a cosmetic applicator according to a certain aspect of the present invention includes an applying portion formed by integrating a comb member having thin-plate-shaped comb teeth extending downward and formed at equal intervals in a longitudinal direction of a substantially semi-cylindrical applicator body open upward and extending in a front-rear direction on a lower surface of the applicator body, and a brush member forming a brush bristle body having brush bristles extending radially from a linear core wire stem and in a columnar form surrounding the core wire stem, and is configured so that the applying portion is configured so that core wire stem front and rear end portions of the brush member are respectively supported on bearings provided coaxially with the applicator body of the comb member at front and rear end portions of the applicator body, and a substantially upper half region of the brush bristle body accommodated in the applicator body is exposed above the applicator body, wherein the brush member is configured so that the brush member is cantilevered on the comb member by fixing a rear end portion of the core wire stem to the rear end side bearing extending to a rear side of the applicator body and having a U-shaped cross section open upward, and the front end portion of the core wire stem is engaged with the front end side bearing extending in an upstanding wall shape at a front upper side of the applicator body and having a U-shaped cross section open downward, and tip ends of respective brush bristles in a substantially lower half region of the brush bristle body accommodated in the applicator body are flush with and in contact with an inner circumferential surface of the applicator body.

According to this aspect, in the comb member as an injection molding product, comb teeth and bearings are integrally formed on the substantially semi-cylindrical applicator body open upward and extending in the front-rear direction, and since comb teeth extending downward are formed at equal intervals in a longitudinal direction on a lower surface of the applicator body, and the rear end side bearing is configured to extend to a rear side of the applicator body and have a U-shaped cross section open upward, and on the other hand, the front end side bearing is configured to extend in an upstanding wall shape at a front upper side of the applicator body and have a U-shaped cross section open downward, when cavities for molding the comb member is formed by using a pair of upper and lower molds which move in approaching and separating directions (up-down direction), cavities corresponding to comb teeth and bearings do not constitute undercuts. Therefore, without employing a complicated mold structure such as split molds, the comb member including the bearings integrally formed on front and rear end portions of the applicator body having comb teeth formed on a lower surface can be injection-molded by a pair of molds which move to approach and separate in the up-down direction and are simple.

In order to fit the brush member to the comb member, a tip end portion (core wire stem front end portion) of the brush member is inserted from a rear side inside the applicator body diagonally downward and forward into the front end side bearing extending in an upstanding wall shape at a front upper side of the applicator body of the comb member and open downward, and a brush member rear end side is turned (tilted) down around the front end side bearing with which the tip end portion (core wire stem front end portion) of the brush member engages, and accordingly, the brush bristle body can be engaged with the applicator body and the core wire stem rear end portion can be engaged with the rear end side bearing open upward.

The brush bristle body engaged with the applicator body is positioned and held in a state where tip ends of respective brush bristles in a substantially lower half region of the brush bristle body are flush with and in contact with an inner circumferential surface of the applicator body, and the tip end portion (core wire stem front end portion) and the rear end portion (core wire stem rear end portion) of the brush member are respectively engaged with the front end side bearing and the rear end side bearing, that is, the brush member and the comb member constituting the applying portion are positioned and held coaxially, so that work to make a cantilevered structure of the brush member on the comb member by fixing the core wire stem rear end portion of the brush member to the bearing at the rear end side of the comb member, can be smoothly performed.

In the cosmetic applicator according to this aspect, the brush member may be positioned in an axial direction with respect to the comb member by respectively bringing a front end portion and a rear end portion of the brush bristle body accommodated in the applicator body into contact with an opening rim portion of the front end side bearing leading to the inside of the applicator body and an opening rim portion of the rear end side bearing leading to the inside of the applicator body.

According to this aspect, the comb member and the brush member fitted and integrated together as the applying portion are held in a state where they are coaxially positioned, and are also held in a state where they are positioned in the axial direction, so that in a cantilevered structure in which the core wire stem rear end portion of the brush member is fixed to the bearing at the rear end side of the comb member, the shape of the entire brush bristle body exposed from the applicator body of the applying portion becomes constant without variation among products.

Accordingly, a cosmetic applicator including an applying portion configured so that the shape of the entire brush bristle body exposed from the applicator body is constant without variation among products can be provided.

In the cosmetic applicator according to this aspect, the core wire stem of the brush member may be disposed so as to be substantially flush with left and right side edge portions of the applicator body in a cross section of the applying portion.

Generally, inside an opening of a cosmetic container, a wiper for wiping off excess cosmetic liquid (for example, a mascara liquid) attaching to an applying portion inside the cosmetic container is provided. By wiping the applying portion to which a cosmetic liquid attaches inside the cosmetic container with a wiper when the applying portion is pulled out from the cosmetic container, excess cosmetic liquid other than the cosmetic liquid held in gaps between comb teeth in the comb member is wiped off, and the cosmetic liquid held on brush bristles exposed from the applicator body in the brush member is partially wiped off and adjusted to an appropriate amount.

An inner diameter (wiping diameter) of the wiper and an amount of cosmetic liquid to be wiped off with the wiper are substantially in inverse proportion to each other, so that the amount of cosmetic liquid to be wiped off with the wiper is adjusted by the inner diameter (wiping diameter) of the wiper.

For example, when it is desired to apply a cosmetic liquid to application target hair not only by the comb teeth of the applying portion but also by the brush bristles of the applying portion, it is desirable that certain amounts of cosmetic liquid are also held on the brush bristle body of the applying portion, so that a wiper with a comparatively large inner diameter (wiping diameter) is employed. On the other hand, when it is desired to use the brush bristles of the applying portion only for arranging application target hair to which a cosmetic liquid has been applied with the comb teeth of the applying portion, it is desirable to hold small amounts of cosmetic liquid on the brush bristles of the applying portion, so that a wiper with a comparatively small inner diameter (wiping diameter) is employed.

In a cross section of the applying portion, when the core wire stem of the brush member is disposed at a lower position than left and right side edge portions of the applicator body, the cosmetic liquid at base sides of the brush bristles exposed from the applicator body cannot be sufficiently wiped off, so that it is difficult to adjust the cosmetic liquid to be held on the brush bristles exposed from the applicator body.

On the other hand, when the core wire stem of the brush member is disposed at a position higher than the left and right side edge portions of the applicator body, the cosmetic liquid can be wiped off with the wiper to base sides of the brush bristles exposed from the applicator body, so that it is easy to adjust the cosmetic liquid to be held on the brush bristles. However, the rear end portion of the core wire stem of the brush member is cantilevered on the comb member, so that when the applying portion is wiped with the wiper, due to a compression force of the wiper acting between the brush member and the comb member, the core wire stem of the brush member warps in a direction in which the core wire stem sinks to the inside of the applicator body, and accordingly, the amount to be wiped off with the wiper may differ in the longitudinal direction of the applying portion.

However, according to this aspect, the core wire stem of the brush member is disposed so as to be substantially flush with left and right side edge portions of the applicator body, and accordingly, when the applying portion is wiped with the wiper, a compression force acting between the brush member and the comb member is small. Further, since tip ends of the respective brush bristles of the brush bristle body accommodated in the applicator body are flush with and in contact with the inner circumferential surface of the applicator body, a reactive force (resilient force) acting between the brush bristle body and the inner circumferential surface of the applicator body reliably suppresses warping of the core wire stem of the brush member. Therefore, when the applying portion is wiped with the wiper, the core wire stem of the brush member does not warp.

Therefore, regardless of specifications including a different inner diameter (wiping diameter) (including a different wiping force) the wiper has, when the applying portion is wiped with the wiper, an amount of cosmetic liquid to be wiped off the applying portion becomes constant in the longitudinal direction of the applying portion, so that the amounts of cosmetic liquid held on the brush bristles of the brush bristle body exposed from the applicator body are adjusted to be the same at any position in the longitudinal direction of the applicator body. Therefore, a cosmetic applicator including an applying portion with excellent operability can be provided.

In the cosmetic applicator according to this aspect, it is also possible that

- a rear end portion of the core wire stem of the brush member is swaged and fixed to a hollow shaft tip end portion together with the bearing at the rear end side of the applicator body.

According to this aspect, in a state where the brush member is fitted to the comb member, that is, front and rear end portions of the core wire stem of the brush member are respectively engaged with the bearings at the front and rear end sides of the applicator body of the comb member, and the brush bristle body of the brush member is engaged with the applicator body of the comb member, the bearing at the rear end side of the applicator body is inserted into the hollow shaft tip end portion integrally with the core wire stem rear end portion, and an outer circumferential surface of the shaft tip end portion is swaged to the inside, and accordingly, the applying portion is attached to the hollow shaft tip end portion, and the brush member constituting the applying portion is cantilevered on the comb member.

Therefore, just by swaging the rear end portion of the applying portion to the hollow shaft tip end portion, fixation of the applying portion to the shaft tip end portion and a cantilevered structure of the brush member in the applying portion are realized at the same time, so that the work efficiency in manufacturing the cosmetic applicator is excellent.

In the cosmetic applicator according to this aspect, it is also possible that

- the front end side bearing is formed into a spherical pointed portion having a gate shape in a front view, provided at a position separated forward from a comb tooth at a forefront position, and
- a comb-tooth-shaped projection portion narrower in width and shorter in extending length than the comb tooth is provided between the comb tooth at the forefront position and the spherical pointed portion.

According to this aspect, the front end portion of the applying portion is formed of a spherical pointed portion, so that the applying portion can be smoothly inserted into the cosmetic container without being caught on an opening of the cosmetic container and the wiper provided inside the opening.

In addition, when the applying portion is pulled out from the wiper, just before the wiper wiping on the brush bristle body of the applying portion is caught on a back surface of the spherical pointed portion, the wiper slides along a front surface of the comb-tooth-shaped projection portion and a front surface of the spherical pointed portion from the comb tooth at the forefront position due to a diameter compression force inherent in the wiper, so that the spherical pointed portion constituting the front end portion of the applying portion can smoothly pass through the wiper, that is, the applying portion can be smoothly pulled out from the wiper.

In the cosmetic applicator according to this aspect, it is also possible that a front surface of the comb-tooth-shaped projection portion is formed into a shape following a front surface of the spherical pointed portion.

According to this aspect, resistance when the front end portion of the applying portion is inserted through the wiper and resistance when the front end portion of the applying portion is pulled out from the wiper become even smaller, so that the applying portion can be still more smoothly inserted into and pulled out from the cosmetic container.

In the cosmetic applicator according to this aspect, it is also possible that the comb teeth are formed into beaked shapes narrower in width than a width of the inside of the applicator body and having an acute angle in a front view, and in a substantially lower half of the applicator body, slits arc-shaped in cross section, having widths equal to gaps between the comb teeth, and crossing the body, are formed, and the gaps between the comb teeth communicate with the inside of the applicator body through the slits.

According to this aspect, the comb teeth are formed into beaked shapes narrow in width and having an acute angle in a front view, so that application target hair (for example, eyelashes) can be easily combed with the comb teeth.

In addition, since side surfaces of the comb teeth (side surfaces facing the gaps between the comb teeth) and facing side surfaces of the slits arc-shaped in cross section are formed to be flush with each other, even when areas of the side surfaces of the comb teeth (volumes of gaps between the comb teeth) are small, large amounts of cosmetics (for example, a mascara liquid) can be held in ranges from the gaps between the comb teeth to the insides of the slits.

Therefore, by performing an operation to comb application target hair (for example, eyelashes) with the comb teeth of the applying portion, the application target hair (eyelashes) can be smoothly combed, and in addition, large amounts of cosmetics (for example, a mascara liquid) held in ranges from the gaps between the comb teeth to the insides of the slits can be applied to the combed application target hair (for example, eyelashes).

Effects of the Invention

As is clear from the description above, according to the present invention, a cosmetic applicator can be provided at a price lowered as much as the reduction in manufacturing cost of the comb member.

In addition, work to fit the brush member to the comb member and integrate these as the applying portion can be smoothly performed.

When the comb member and the brush member are fitted and integrated together as the applying portion, the comb member and the brush member are held in states coaxially positioned, so that work to make a cantilevered structure of the brush member on the comb member by fixing the rear end portion of the core wire stem of the brush member to the bearing at the rear end side of the comb member can be smoothly performed.

In particular, when the brush member is fitted to the comb member, bending (of the core wire stem) of the brush member as in the prior Patent Document 1 is not required at all, so that an external shape of the brush bristle body exposed from the applicator body is always constant, and constant quality of the brush bristle body in the applying portion of the manufactured cosmetic applicator can be guaranteed.

BRIEF DESCRIPTION OF THE DRAWINGS

FIGS. 1A, 1B, 10, and 1D illustrate an applying portion as an essential portion of a mascara applicator according to a first embodiment of the present invention, and FIG. 1A is a perspective view of the same applying portion, FIG. 1B is a longitudinal sectional view of the same applicator, FIG. 10 is an enlarged cross-sectional view (sectional view taken along line Ic-Ic in FIG. 1B) of a swaged and fixed portion of the same applicator, and FIG. 1D is an enlarged cross-sectional view (sectional view taken along line Id-Id in FIG. 1B) of a core wire stem front end portion.

FIG. 2A is a side view of a comb member, FIG. 2B is a plan view of the comb member, FIG. 2C is a bottom view of the comb member, FIG. 2D is a left side view of the comb member (view of the comb member viewed from a front surface side), and FIG. 2E is a right side view of the comb member (view of the comb member viewed from a back side).

FIG. 6A is a side view of a comb member constituting the same applying portion, FIG. 6B is a longitudinal sectional view of the same applying portion, and FIG. 6C is an enlarged cross-sectional view (sectional view taken along line VIc-VIc in FIG. 6A and corresponding to FIG. 4) of the same comb member.

BEST MODE FOR CARRYING OUT THE INVENTION

Hereinafter, embodiments of the present invention will be described.

FIGS. 1A, 1B, and 10 to 5 are views illustrating an applying portion as an essential portion of a mascara applicator according to a first embodiment of the present invention.

Figure 1A:
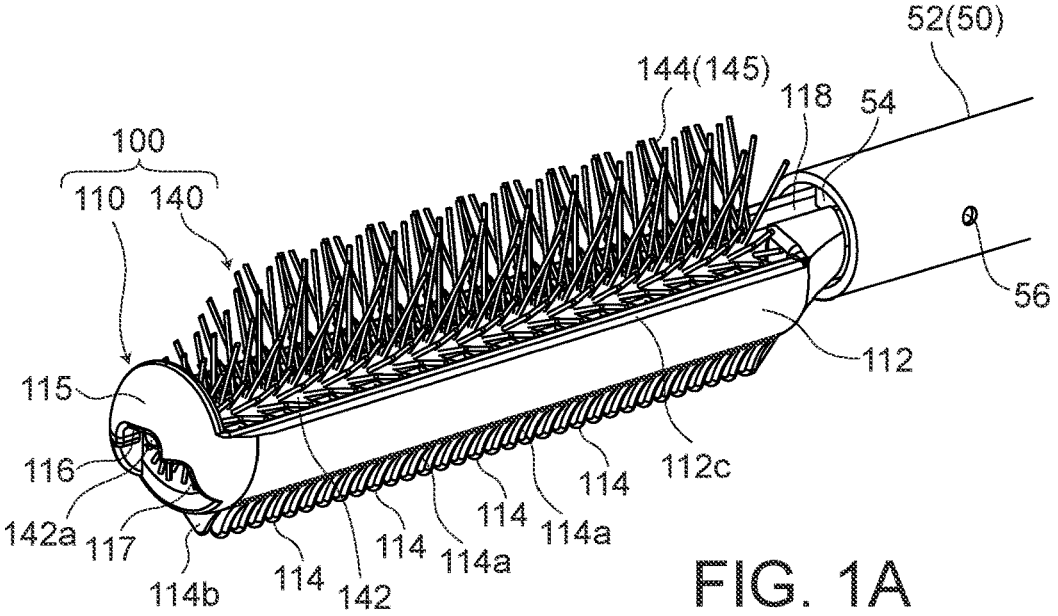

To an opening of a mascara container (not illustrated) storing a mascara liquid as a cosmetic liquid, a cap (not illustrated) is detachably screwed. With this cap, a shaft 50 (refer to FIGS. 1A and 1B) is integrated, and to a hollow tip end portion 52 of the shaft 50, an applying portion 100 formed by integrating a comb member 110 and a brush member 140 coaxially is swaged and fixed. The reference sign 56 in FIG. 1A represents a swaging mark remaining on an outer circumferential surface of the shaft tip end portion 52.

Inside the opening of the mascara container, a wiper (a rubber-made wiping member provided with a circular hole for insertion of the applying portion, having an opening area much smaller than a cross-sectional area of the applying portion 100) for wiping off excess mascara liquid attaching to the applying portion 100 (refer to FIGS. 1A and 1B) inside the mascara container is provided, and the applying portion

100 to which a mascara liquid is attached inside the mascara container is wiped with the wiper when being pulled out from the mascara container, and accordingly, a mascara liquid holding amount in the applying portion 100 is adjusted.

In the mascara applicator of the present embodiment, a wiper with a comparatively large inner diameter (wiping diameter) is employed so that sufficient amounts of mascara liquid can be applied to eyelashes not only by the comb teeth 114 of the applying portion 100 but also by brush bristles 145 of the applying portion 100.

Therefore, when the applying portion 100 is pulled out from the mascara container, large amounts of mascara liquid are held in gaps 114*a* between the comb teeth 114 of the comb member 110, and comparatively large amounts of mascara liquid are also held on the brush bristles 145 of the brush bristle body 144 of the brush member 140 exposed from an applicator body 112.

After the large amounts of mascara liquid are applied to eyelashes by using the comb teeth 114 on a lower surface side of the applying portion 100, the mascara liquid can be further applied to eyelashes to be thicker by using the brush bristle body 144 (brush bristles 145) on an upper surface side of the applying portion 100, or comparatively large amounts of mascara liquid can be applied to eyelashes by using only the brush bristle body 144 (brush bristles 145) on the upper surface side of the applying portion 100 without using the comb teeth 114 on the lower surface side of the applying portion 100, and in such a way, the comb teeth 114 and the brush bristle body 144 (brush bristles 145) of the applying portion 100 can be freely used.

Figure 1B:
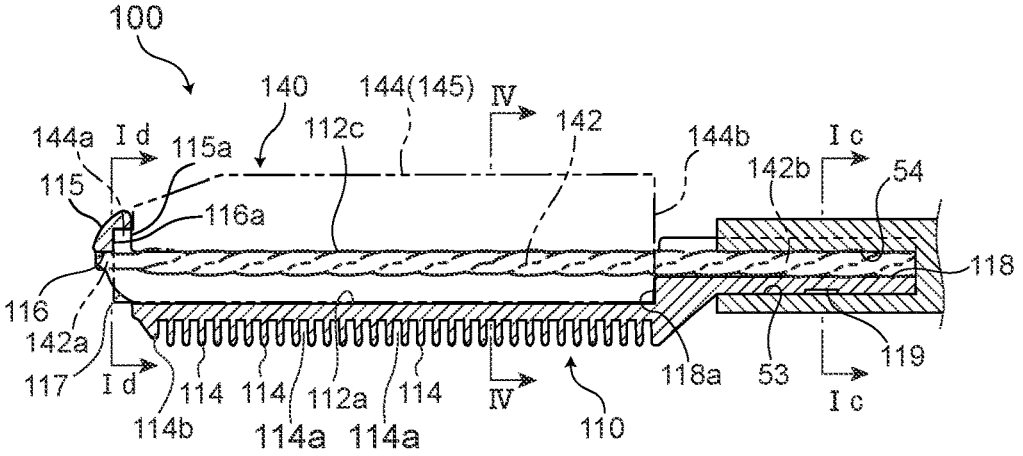
Figure 4:
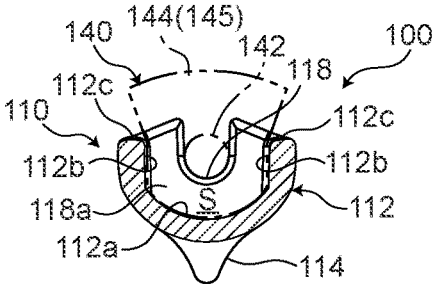
FIG. 4 is an enlarged longitudinal sectional view (enlarged sectional view taken along line IV-IV in FIG. 1B) of the applying portion as an essential portion of the mascara applicator.

In the brush member 140, as illustrated in FIGS. 1A, 1B, and 4, the brush bristle body 144 substantially fan-shaped in cross section is formed around a linear core wire stem 142 so that brush bristles 145 radially extend from the core wire stem 142. The brush member 140 is configured by sandwiching brush bristles with a predetermined length (for example, polyamide synthetic fiber-made bristles with a diameter of 0.1 mm and a length of 8 mm) between metal wire members 141 and 141 formed by half-folding a metal wire member 141 (with a diameter of, for example, 0.75 mm) and twisting the wire members. The brush bristle body 144 substantially fan-shaped in cross section is formed of brush bristles 145 radially dispersed along a spiral groove between the pair of twisted metal wire members 141 and 141, and a front end portion 142*a* of the core wire stem 142 is configured by a folded-back portion (FIGS. 1B and 1D) of the metal wire member 141. Therefore, as illustrated in FIG. 1D, a cross section of the core wire stem front end portion 142*a* as a folded-back portion of the metal wire member 141 is in a flat and horizontally long shape including two circles with a diameter of 0.75 mm laterally adjacent to each other, and on the other hand, a cross section of a region (region in which the metal wire members 141 and 141 are twisted) excluding the front end portion 142*a* of the core wire stem 142 is a circle with a diameter of approximately 1.5 mm formed by twisting the two metal wire members 141 (with a diameter of 0.75 mm).

When brush bristles with a predetermined length are sandwiched between the metal wire members 141 and 141 formed by half-folding, and the metal wire members are twisted, a brush bristle body circular in cross section is formed around the core wire stem 142, and by trimming tip ends of the brush bristles 145 constituting this brush bristle body circular in cross section, the brush bristle body is formed so as to have a predetermined desirable substantially fan-shaped cross section, for example, as illustrated in FIG. 4, a substantially upper half region of the brush bristle body 144 (brush bristles 145 higher than the core wire stem 142) is formed to have a mohawk shape in cross section, and a substantially lower half region of the brush bristle body 144 (brush bristles 145 lower than the core wire stem 142) is formed to have a cross-sectional shape that can be made flush with and accommodated in a brush bristle body accommodation space S described later of the applicator body 112.

Figure 1C:
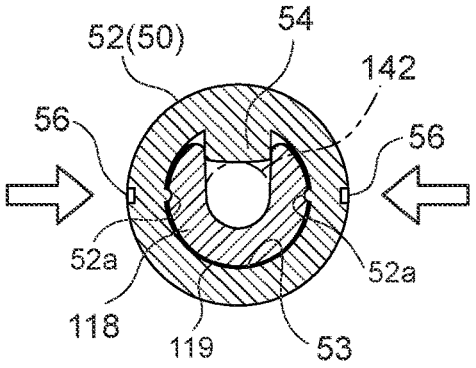
Figure 1D:
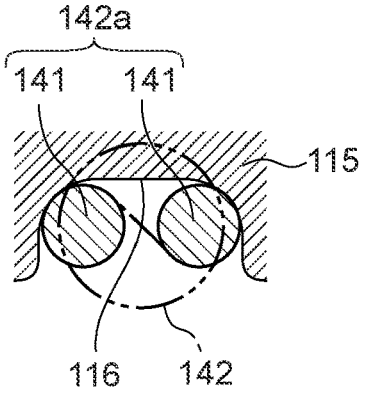

Here, based on the flat and horizontally long cross section of the core wire stem front end portion 142*a* illustrated in FIG. 1D, a brush bristle body 144 formed of brush bristles 145 higher than the core wire stem 142 is referred to as a "substantially upper half region of the brush bristle body 144," and a brush bristle body 144 formed of brush bristles 145 lower than the core wire stem 142 is referred to as a "substantially lower half region of the brush bristle body 144."

On the other hand, the comb member 110 includes a substantially semi-cylindrical applicator body 112 open upward and extending in the front-rear direction, and on a lower surface of the applicator body 112, comb teeth 114 having thin plate shapes extending downward are formed at equal intervals in a longitudinal direction of the body 112. An extending length of the comb teeth 114 (a length from an outer circumferential surface of the applicator body 112 to tip ends of the comb teeth 114) is approximately 1.6 mm, a thickness of the comb teeth 114 is 0.40 mm, and intervals of the comb teeth 114 are 0.75 mm, and gaps 114*a* between the comb teeth 114 are set to 0.35 mm.

Figure 3A:
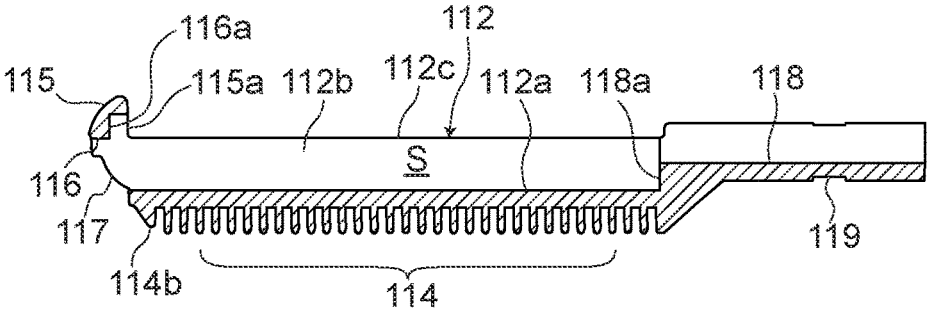
FIG. 3A is a longitudinal sectional view of the comb member.
Figure 3B:
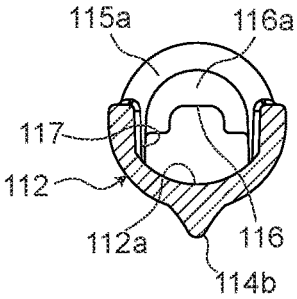
FIG. 3B is an enlarged cross-sectional view (sectional view taken along line IIIb-IIIb in FIG. 2A) of the comb member.
Figure 3C:
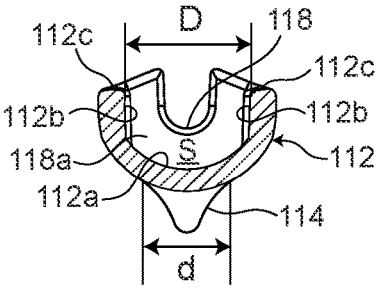
FIG. 3C is an enlarged cross-sectional view (sectional view taken along line IIIc-IIIc in FIG. 2A) of the comb member.

In particular, as illustrated in FIG. 3C, the comb tooth 114 is formed into a beaked shape having a narrower width d at a base side than a width D of the inside of the applicator body 112 and having an acute angle in a front view, so that eyelashes can be easily combed with the comb teeth 114. In addition, in the gaps 114 between the comb teeth 114, large amounts of mascara liquid can be held.

As illustrated in FIGS. 1B, 3A, and 3C, an inner circumferential surface 112*a* of a substantially lower half in the up-down direction of the applicator body 112 is arc-shaped, and inner circumferential surfaces 112*b* and 112*b* facing each other in a width direction in a substantially upper half in the up-down direction of the applicator body 112 are formed of vertical surfaces, and inside the applicator body 112, a brush bristle body accommodation space S that accommodates the brush bristle body 144 of the brush member 140 is provided.

At a front end side of the applicator body 112, as illustrated in FIG. 3A, a bearing 116 that supports a tip end portion (core wire stem front end portion) 142*a* of the brush member 140 is formed, and at a rear end side of the applicator body 112, a bearing 118 that supports a base end portion (core wire stem rear end portion) 142*b* of the brush member 140 is formed, respectively integrally and coaxially with the applicator body 112.

The rear end side bearing 118 is formed to extend to a rear side of the applicator body 112 and have a U-shaped cross section open upward as illustrated in FIGS. 1, 2A to 2C, 2E, 3A, and 3C, and an opening rim portion 118*a* of the bearing 118 leading to the inside of the body 112 forms a rear surface of the brush bristle body accommodation space S inside the applicator body 112 as illustrated in FIGS. 1B, 3A, and 3C.

On the other hand, the front end side bearing 116 is formed to have a wide U-shaped cross section open downward with which the front end portion of the core wire stem 142 (folded-back portion of the metal wire member 141) of the brush member 140 can engage from below at a center of a spherical pointed portion 115 which extends in an upstanding wall shape at a front upper side of the applicator body 112 and has a gate shape open downward in a front view.

As illustrated in FIGS. 3A and 3B, an opening rim portion 116*a* of the front end side bearing 116 leading to the inside of the applicator body 112 is a stepped surface formed on a rear surface of the spherical pointed portion 115, and forms a brush bristle body accommodation space S forming surface inside the applicator body 112.

As illustrated in FIG. 1B, the brush bristle body 144 accommodated in the brush bristle body accommodation space S of the applicator body 112 is configured so that a small-diameter front end portion 144*a* of the brush bristle body 144 formed of brush bristles 145 having short extending lengths from the core wire stem 142 comes into contact with the opening rim portion 116*a* (a front surface of the brush bristle body accommodation space S) of the bearing 116 leading to the inside of the applicator body 112, and a rear end portion 144*b* of the brush bristle body 144 comes into contact with the opening rim portion 118*a* of the rear end side bearing 118 leading to the inside of the applicator body 112, and accordingly, the comb member 110 and the brush member 140 are positioned in an axial direction.

In addition, tip ends of the respective brush bristles 145 in the substantially lower half region of the brush bristle body 144 accommodated inside the body 112 become flush with and come into contact with the inner circumferential surfaces (brush bristle body accommodation space S forming surfaces) 112*a* and 112*b* of the applicator body 112, and accordingly, the substantially upper half region of the brush bristle body 114 is exposed above the applicator body 112, and the tip end portion (core wire stem front end portion) 142*a* and the rear end portion (core wire stem rear end portion) 142*b* of the brush member 140 are positioned so as to be respectively engaged with the bearing 116 at the front end side and the bearing 118 at the rear end side of the comb member 110 (applicator body 112). That is, the comb member 110 and the brush member 140 are positioned coaxially.

Then, in a state where the comb member 110 and the brush member 140 constituting the applying portion 110 are positioned coaxially and positioned in the axial direction, the comb member 110 and the brush member 140 are swaged and fixed to the hollow tip end portion 52 of the shaft 50 extending from the cap (not illustrated) of the mascara container.

That is, the applying portion 110 swaged and fixed to the hollow shaft tip end portion 52 is disposed so that the brush member 140 is cantilevered on the comb member 110 by fixing the core wire stem rear end portion 142*b* of the brush member 140 to the bearing 118 at the rear end side of the comb member 110, the core wire stem front end portion 142*a* of the brush member 140 engages with the bearing 116 at the front end side of the comb member 110, the brush bristle body 144 of the brush member 140 engages with the applicator body 112, and tip ends of the respective brush bristles 145 in the substantially lower half region of the brush bristle body 144 become flush with and come into contact with the inner circumferential surfaces 112*a* and 112*b* of the applicator body 112, and the substantially upper half region of the brush bristle body 144 is exposed above the applicator body 112.

Inside the opening of the mascara container, a wiper for wiping off excess mascara liquid attaching to the applying portion 100 is provided, and in the present embodiment, by providing the spherical pointed portion 115 having an upstanding wall shape covering the tip end portion (core wire stem front end portion) 142*a* of the brush member 140 cantilevered on the comb member 110, the applying portion 100 can be smoothly inserted to the inside of the mascara container without being caught on the opening and the wiper of the mascara container.

As indicated by the reference sign 117 in FIGS. 1A, 1B, FIGS. 2A, 2C, 2D, and FIG. 3B, a lower side of the bearing 116 provided on the spherical pointed portion 115 is open widely in the front-rear direction, and accordingly, when the applying portion 100 is inserted into the mascara container, supply (intrusion) of a mascara liquid inside the mascara container to the brush bristle body 144 of the applying portion 100 is promoted, and when the applying portion 100 is pulled out from the mascara container, discharge of excess mascara liquid inside the brush bristle body 144 wiped with the wiper into the mascara container is promoted.

In addition, as illustrated in FIGS. 1A, 1B, FIGS. 2A, 2C, 2D, and FIG. 3A, the spherical pointed portion 115 having an upstanding wall shape provided at a front end portion of the applicator body 112 (comb member 110) is provided so as to be separated forward from the comb tooth 114 at the forefront position, and a comb-tooth-shaped projection portion 114*b* narrower in width and shorter in extending length than the comb tooth 114 is provided between the comb tooth 114 at the forefront position and the spherical pointed portion 115, and accordingly, the applying portion 100 is easily pulled out from the wiper.

Specifically, in the case where the spherical pointed portion 115 having an upstanding wall shape is provided near a front side of a comb tooth 114 forming position, when the applying portion 100 is pulled out from the wiper, the wiper (circular hole rim portion of the wiping member) is caught on a back surface 115*a* (refer to FIG. 1B, FIGS. 2A, 2B, and 2E) of the spherical pointed portion 115 and obstructs smooth pulling-out of the applying portion 100. However, in the present embodiment, a distance from the comb tooth 114 at the forefront position to the back surface 115*a* of the spherical pointed portion 115 is long in the front-rear direction (refer to the reference sign 5 in FIG. 2A), and further, between the comb tooth 114 at the forefront position and the back surface 115*a* of the spherical pointed portion 115, the comb-tooth-shaped projection portion 114*b* narrower in width and shorter in extending length than the comb tooth 114 is provided, so that when the applying portion 100 is pulled out from the wiper, just before the wiper wiping on the brush bristle body 144 of the applying portion 100 is caught on the back surface 115*a* of the spherical pointed portion 115, the wiper slides along the front surface of the comb-tooth-shaped projection portion 114*b* and the front surface of the spherical pointed portion 115 from the comb tooth 114 at the forefront position due to a diameter compression force inherent in the wiper, so that the spherical pointed portion 115 constituting the front end portion of the applying portion 100 can smoothly pass through the wiper, that is, the applying portion 100 can be smoothly pulled out from the wiper.

Next, a swaged and fixed structure of the applying portion 100 to the hollow shaft tip end portion 52 will be described.

As illustrated in FIGS. 1A and 1C, the hollow shaft tip end portion 52 is formed into a cylindrical shape having a slot 53 opened forward in which the bearing 118 at the rear end side of the comb member 110 can be inserted, and at a predetermined position in a circumferential direction of an inner circumferential surface of the slot 53, a vertical rib 54 rectangular in cross section which engages with the bearing 118 in the axial direction is provided to project. The vertical rib 54 engages with an upper opening of the bearing 118, and comes into contact with side surfaces of the core wire stem rear end portion 142*b* supported on the bearing 118, and accordingly, the applying portion 100 is positioned around an axis of the shaft 50.

As illustrated in FIGS. 2A and 2C, on an outer circumferential surface of the bearing 118 having a U-shaped cross section, a narrow belt-shaped reduced-diameter portion 119 indicating a swaging planned position is provided, and as indicated by an outlined arrow in FIG. 10, at a position corresponding to the reduced-diameter portion 119, when the outer circumference of the shaft tip end portion 52 is swaged in a direction orthogonal to a central axis of the core wire stem rear end portion 142*b*, a resin material forming the swaged shaft 52 is plastically deformed so as to clamp the reduced-diameter portion 119 of the bearing 118 as indicated by the reference signs 52*a*, and the core wire stem rear end portion 142*b* and the bearing 118 are fixed to and integrated with the shaft tip end portion 52.

That is, in the present embodiment, by swaging the outer circumferential surface of the hollow shaft tip end portion 52 to the inside, the applying portion 100 is attached and fixed to the shaft tip end portion 52, and simultaneously, the brush member 140 constituting the applying portion 100 is cantilevered on the comb member 110.

Figure 5:
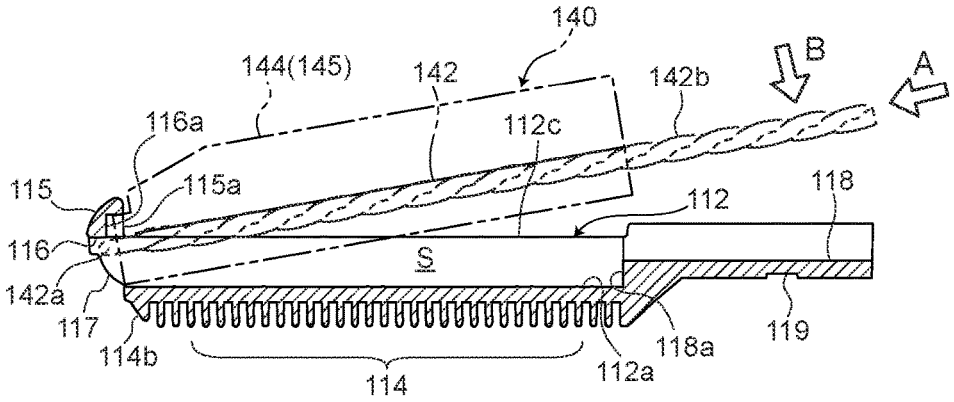
FIG. 5 is an explanatory view describing procedures of fitting a brush member to the comb member.

In order to fit the brush member 140 to the comb member 110, as indicated by the arrow A in FIG. 5, from a rear side inside the applicator body 112, the tip end (core wire stem front end portion) 142*a* of the brush member 140 is inserted diagonally forward and downward to the front end side bearing 116 extending in an upstanding wall shape and open downward at a front upper side of the comb member 110 (applicator body 112), and as indicated by the arrow B, the brush member rear end portion (core wire stem rear end portion) 142*b* is turned (tilted) down around the front end side bearing 116 with which the tip end (core wire stem front end portion) 142*a* of the brush member 140 engages, and accordingly, the brush bristle body 144 can be engaged with the applicator body 112, and the brush member rear end portion (core wire stem rear end portion) 142*b* can be engaged with the rear end side bearing 118.

Then, the brush bristle body 144 engaging with the applicator body 112 is positioned and held in a state where tip ends of the respective brush bristles 145 in a substantially lower half region of the brush bristle body 144 are flush with and in contact with inner circumferential surfaces 112*a* and 112*b* of the applicator body 112, and the tip end portion (core wire stem front end portion) 142*a* and the rear end portion (core wire stem rear end portion) 142*b* of the brush member 140 are respectively engaged with the bearing 116 at the front end side and the bearing 118 at the rear end side of the comb member 110 (applicator body 112).

That is, when the brush member 140 is fitted to and integrated with the comb member 110, the brush member 140 and the comb member 110 constituting the applying portion 100 are made coaxial and positioned and held in the axial direction, so that the work to swage and fix the rear end portion of the applying portion 100 to the hollow shaft tip end portion 52 can be smoothly performed.

In addition, when the applying portion 100 is pulled out from the mascara container (when the applying portion 100 passes through the wiper), the applying portion 100 is wiped with the wiper and excess mascara liquid attaching to the brush bristles 145 of the brush bristle body 144 exposed from the applicator body 112 is wiped off, and accordingly, amounts of mascara liquid held on the brush bristles 145 of the brush bristle body 144 exposed from the applicator body 112 of the applying portion 100 are adjusted.

In the present embodiment, a wiper with a comparatively large inner diameter (wiping diameter) is provided inside the mascara container so as to enable an operation of applying comparatively large amounts of mascara liquid to eyelashes not only by the comb teeth 114 of the applying portion 100 but also by the brush bristles 145 of the brush bristle body 144 of the applying portion 100, and certain amounts (comparatively large amounts) of mascara liquid are held on the brush bristle body 144 of the applying portion 100 pulled out from the mascara container.

Further, in the present embodiment, in a cross section of the applying portion 100 illustrated in FIG. 4, since the core wire stem 142 of the brush member 140 is disposed so as to be substantially flush with upper surfaces 112*c* of left and right side edge portions of the applicator body 112, when the applying portion 100 is wiped with the wiper, an amount of mascara liquid to be wiped off the applying portion 100 becomes constant in the longitudinal direction of the applying portion 100, and amounts of mascara liquid held on the brush bristles 145 of the brush bristle body 144 exposed from the applicator body 112 are adjusted to be the same at any position in the longitudinal direction of the applicator body 112.

Specifically, in a cross section of the applying portion 100 illustrated in FIG. 4, when the core wire stem 142 of the brush member 140 is disposed at a position higher than the upper surfaces 112*c* of the left and right side edge portions of the applicator body 112, the cosmetic liquid can be wiped off with the wiper to base sides of the brush bristles 145 exposed from the applicator body 112, so that the cosmetic liquid to be held on the brush bristles 145 is easily adjusted. However, the rear end portion of the core wire stem 142 of the brush member 140 is cantilevered on the comb member 110, so that when the applying portion 100 is wiped with the wiper, due to a compression force of the wiper acting between the brush member 140 and the comb member 110, the core wire stem 142 of the brush member 140 warps in a direction in which the core wire stem 142 of brush member 140 sinks to the inside of the applicator body 112, and therefore, an amount to be wiped off with the wiper may differ in the longitudinal direction of the applying portion 100.

However, in the present embodiment, the core wire stem 142 of the brush member 140 is disposed so as to be substantially flush with the upper surfaces 112*c* of the left and right side edge portions of the applicator body 112, and accordingly, when the applying portion 100 is wiped with the wiper, the compression force acting between the brush member 140 and the comb member 100 becomes smaller.

Further, in the present embodiment, as described above, since the inner diameter (wiping diameter) of the wiper provided inside the mascara container is comparatively large so that certain amounts (comparatively large amounts) of mascara liquid are held on the brush bristle body 144 of the applying portion 100 pulled out from the mascara container, when the applying portion 100 is wiped with the wiper, the compression force acting between the brush member 140 and the comb member 110 becomes even smaller.

Further, since the tip ends of the respective brush bristles 145 in a substantially lower half region of the brush bristle body 144 accommodated in the applicator body 112 are disposed so as to become flush with and come into contact with the inner circumferential surfaces 112*a* and 112*b* of the applicator body 112, due to a compression force of the wiper acting between the brush member 140 and the comb member 110, with respect to the motion of the core wire stem 142 of the brush member 140 to elastically deform (tries to warp), a reactive force (resilient force) acting between the tip ends of the brush bristles 145 of the brush bristle body 144 and the inner circumferential surfaces 112*a* and 112*b* of the applicator body 112 suppresses the elastic deformation (warping) of the core wire stem 142 of the brush member 140.

In particular, in the present embodiment, as illustrated in FIG. 4, as compared with the brush bristles 145 higher than the core wire stem 142 (brush bristles 145 exposed above the applicator body 112), the brush bristles 145 lower than the core wire stem 142 (brush bristles 145 disposed inside the applicator body 112) are shorter in length, and increase in rigidity according to the shortness, so that the reactive force (resilient force) acting between the brush bristle body 144 and the inner circumferential surface 112*a* of the applicator body 112 reliably suppresses the elastic deformation (warping) of the core wire stem 142 of the brush member 140.

Therefore, in the present embodiment, when the applying portion 100 is wiped with the wiper, the core wire stem 142 of the brush member 140 does not warp with respect to the comb member 110, and is held in a state where the core wire stem is disposed so as to be substantially flush with the upper surfaces 112*c* of the left and right side edge portions of the applicator body 112.

Therefore, an amount to be wiped off of excess mascara liquid attaching to the brush bristles 145 of the brush bristle body 44 exposed from the applicator body 112 by the wiper is adjusted to be constant in the longitudinal direction of the applying portion 100, and amounts of mascara liquid held on the brush bristles 145 of the brush bristle body 144 exposed from the applicator body 112 are adjusted to be constant in the longitudinal direction of the applying portion 100.

Therefore, by pulling out the applying portion 100 from the mascara container, the amounts of mascara liquid held on the brush bristles 145 of the brush bristle body 144 exposed from the applicator body 112 are the same at any position in the longitudinal direction of the applying portion 100, so that even amounts of mascara liquid can be applied to a plurality of eyelashes.

In addition, on the comb member 110 as an injection molding product, the comb teeth 114 and the bearings 116 and 118 are formed integrally with the substantially semi-cylindrical applicator body 112 open upward and extending in the front-rear direction, and in the present embodiment, the comb teeth 114 extending downward are formed at equal intervals in the longitudinal direction of the applicator body 112 on a lower surface of the applicator body 112, and the rear end side bearing 118 is formed into a shape extending to a rear side of the applicator body 112 and having a U-shaped cross section open upward, and on the other hand, the front end side bearing 116 is formed into a shape extending in an upstanding wall shape at a front upper side of the applicator body 112 and having a U-shaped cross section open downward, so that when cavities for molding the comb member are formed in a pair of upper and lower molds for injection molding which move in approaching and separating directions (up-down direction), cavities corresponding to the comb teeth 114 and the bearings 116 and 118 do not form undercuts.

Therefore, in the present embodiment, without employing a complicated mold structure such as split molds, the comb member 110 including the bearings 116 and 118 integrally formed on front and rear end portions of the applicator body 112 having comb teeth 114 on a lower surface can be injection-molded by using a pair of simple mold structures that move to approach and separate in the up-down direction.

Therefore, in the present embodiment, according to the reduction in manufacturing cost of the comb member 110, the cosmetic applicator can be provided at a low price.

Figure 6A:
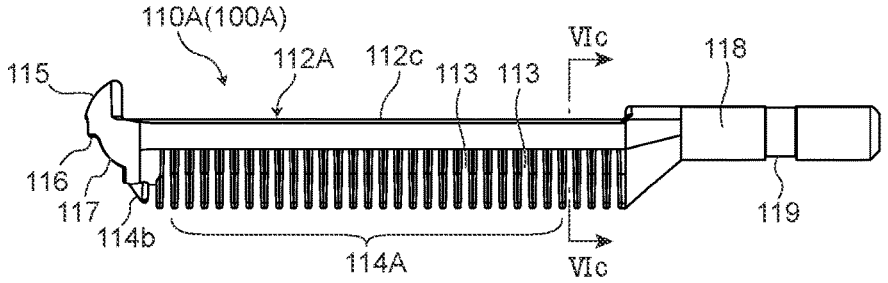
FIGS. 6A, 6B, and 6C illustrate an applying portion as an essential portion of a mascara applicator according to a second embodiment of the present invention.

FIG. 6 illustrates an applying portion 100A as an essential portion of a mascara applicator according to a second embodiment of the present invention.

In the applying portion 100A of this second embodiment, an extending length of a comb tooth 114A of a comb member 110A and a structure of an applicator body 112A are different from those of the applying portion 100 of the first embodiment described above, and these differences from the first embodiment will be described.

(First Difference)

An extending length of the comb teeth 114A formed on a lower surface of the applicator body 112A (a length from an outer circumferential surface of the applicator body 112A to tip ends of the comb teeth 114A) is approximately 1.3 mm, and is about 0.3 mm shorter than (approximately 20% of) an extending length of approximately 1.6 mm of the comb teeth 114 formed on the lower surface of the applicator body 112 of the first embodiment.

Therefore, when the applying portion 100A is pulled out from or inserted into the mascara container (when the applying portion 100A passes through the wiper), the applying portion 100A is subjected to wiping resistance by the wiper, however, according to the shortness of the extending length of the comb teeth 114A from the applicator body 112A, the wiping resistance by the wiper becomes smaller, and accordingly, the applying portion 100A is smoothly pulled out from and inserted into the mascara container.

(Second Difference)

In a substantially lower half region of the applicator body 112A in the up-down direction, slits 113 having the same widths as those of the gaps 114A between the comb teeth 114A are provided, and a mascara liquid can be held in the gaps 114*a* between the comb teeth 114A and inside the slits 113.

In particular, in this second embodiment, even when an extending length of the comb teeth 114 is short, large amounts of mascara liquid can be held inside the slits 113 communicating with the gaps 114*a* between the comb teeth 114A.

Specifically, the comb member 110A includes a substantially semi-cylindrical applicator body 112A open upward and extending in the front-rear direction, and on a lower surface of the applicator body 112A, comb teeth 114A having thin-plate shapes extending downward are formed at equal intervals in the longitudinal direction of the body 112A. An extending length of the comb teeth 114A (length from an outer circumferential surface of the applicator body 112A to tip ends of the comb teeth 114A) is set to approximately 1.3 mm, a thickness of the comb teeth 114A is set to 0.40 mm, intervals of the comb teeth 113 are set to 0.75 mm, and gaps between the comb teeth 114A are set to 0.35 mm.

In a substantially lower half of the applicator body 112A, slits 113 arc-shaped in cross section, having widths equal to the gaps 114*a* between the comb teeth 114A, and crossing the body 112A, are formed at equal intervals in the longitudinal direction, and the gaps 114*a* between the comb teeth 114A communicate with the inside of the applicator body 112A (brush bristle body accommodation space S) through the slits 113.

Figure 6B:
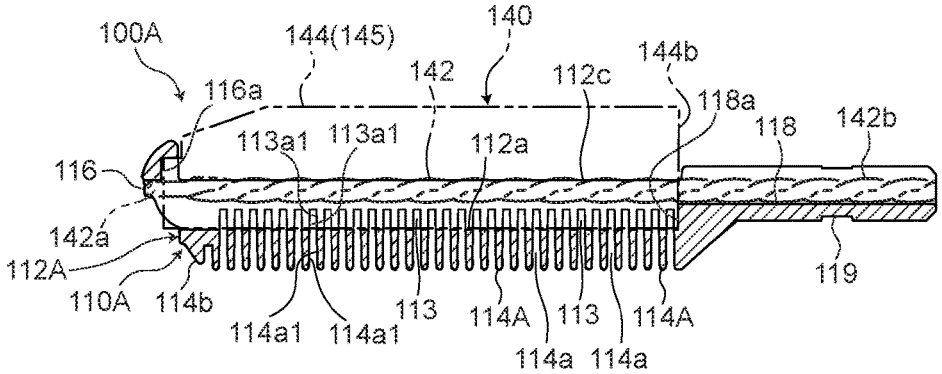
Figure 6C:
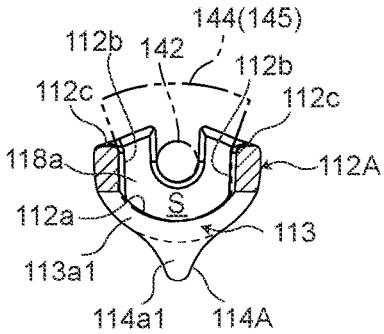

As illustrated in FIGS. 6B and 6C, facing side surfaces 114*a*1 of the comb teeth 114A (side surfaces facing the gaps 114*a* between the comb teeth 114) and facing side surfaces 113*a*1 of the slits 113 arc-shaped in cross section are formed to be flush with each other, and even when areas of the facing side surfaces 114*a*1 of the comb teeth 114A (volumes of the gaps 114*a* between the comb teeth 114A) are small, areas of facing side surfaces 113*a*1 of the slits 113 (volumes of the slits 113) communicating with the gaps 114*a* between the comb teeth 114A are sufficiently large, and accordingly, large amounts of mascara liquid can be held in the gaps 114*a* between the comb teeth 114 and in the slits 113.

Further, a substantially upper half region of the brush bristle body 144 exposed from the applicator body 112A is wiped with the wiper, and accordingly, small amounts of mascara liquid are held between brush bristles 145 exposed from the applicator body 112A. On the other hand, in a substantially lower half region of the brush bristle body 144 accommodated inside the applicator body 112A which is not wiped with the wiper, larger amounts of mascara liquid can be held between the brush bristles 145 than in the substantially upper half region of the brush bristle body 144 (brush bristles 145 exposed above the applicator body 112A), so that large amounts of mascara liquid can be held in ranges from the gaps 114A between the comb teeth 114A to the slits 113 and the substantially lower half region of the brush bristle body 144 inside the applicator body 112A.

As described above, in the second embodiment, according to an extending length of the comb teeth 114A approximately 0.3 mm shorter than that in the first embodiment, amounts of mascara liquid that can be held in the gaps 114*a* between the comb teeth 114A become smaller, however, large amounts of mascara liquid can be held in ranges from the gaps 114*a* between the comb teeth 114A to the slits 113 and the substantially lower half region of the brush bristle body 144 inside the applicator body 112.

Therefore, larger amounts of mascara liquid can be applied to eyelashes by the comb teeth 114A of the applying portion 100A of the second embodiment than by the comb teeth 114 of the applying portion 100 of the first embodiment.

Other configurations are the same as in the applying portion 100 of the first embodiment, and by providing the same reference signs, overlapping descriptions of them are omitted.

In this second embodiment, the comb teeth 114A are also formed into beaked shapes narrow in width and having an acute angle in a front view, so that easiness in combing with the comb teeth 114A is the same as that in combing with the applying portion 100 of the first embodiment described above.

In each of the first and second embodiments described above, a mascara applicator with which a mascara liquid is applied to eyelashes has been described, however, without limitation to a mascara applicator, the present invention can be widely applied to cosmetic applicators with which cosmetics are applied to eyelashes, eyebrows, and head hair, etc.

DESCRIPTION OF SYMBOLS

50 Shaft extending from cap
52 Hollow shaft tip end portion
54 Vertical rib
56 Swaging mark
100, 100A Applying portion
110, 110A Comb member
112, 112A Applicator body
112*a*, 112*b* Applicator body inner circumferential surface
112*c* Upper surface of applicator body side edge portion
S Brush bristle body accommodation space
113 Slit
114, 114A Comb tooth
114*a* Gap between comb teeth
114*b* Comb-tooth-shaped projection portion
δ Separating distance between comb tooth at forefront position and spherical pointed portion in front-rear direction
115 Spherical pointed portion provided at front end side of applicator body
116 Bearing at front end side of applicator body
118 Bearing at rear end side of applicator body
140 Brush member
141 Core wire member
142 Core wire stem
142*a* Core wire stem front end portion
142*b* Core wire stem rear end portion
144 Brush bristle body
145 Brush bristle

The invention claimed is:

1. A cosmetic applicator comprising:

an applying portion formed by integrating a comb member having plate-shaped comb teeth extending downward and formed at equal intervals in a longitudinal direction of a substantially semi-cylindrical applicator body open upward and extending in a front-rear direction on a lower surface of the applicator body, the plate-shaped comb teeth having a first dimension that is less than a second dimension, and a brush member forming a brush bristle body having brush bristles extending radially from a linear core wire stem and having a circular cross section surrounding the linear core wire stem, wherein the applying portion is configured so that the linear core wire stem front and rear end portions of the brush member are respectively supported on front end and rear end side bearings, provided coaxially with the applicator body of the comb member on front and rear end portions of the applicator body, and a substantially upper half region of the brush bristle body accommodated in the applicator body is exposed above the applicator body, wherein the brush member is configured so that the brush member is positioned on the comb member by fixing a rear end portion of the linear core wire stem to the rear end side bearing extending to a rear side of the applicator body, the rear end side bearing having a U-shaped cross section open upward, and the front end portion of the linear core wire stem is engaged with the front end side bearing extending in an upstanding wall at a front upper side of the applicator body, the front end side bearing having a U-shaped cross section open downward, and tip ends of respective brush bristles in a substantially lower half region of the brush bristle body accommodated in the applicator body are flush with and in contact with an inner circumferential surface of the applicator body, and wherein the U-shaped cross section of the rear end side bearing and the U-shaped cross section of the front end side bearing open in opposite directions, wherein the front end portion of the linear core wire stem does not extend beyond the front end side bearing and is engaged with the front end side bearing at a front upper side and not engaged with the front end side bearing at a front lower side of the applicator body such that it is exposed downwardly.

2. The cosmetic applicator according to claim 1, wherein the brush member is positioned in an axial direction with respect to the comb member by respectively bringing a front end portion and a rear end portion of the brush bristle body accommodated in the applicator body into contact with an opening rim portion of the front end side bearing leading to the inside of the applicator body and an opening rim portion of the rear end side bearing leading to the inside of the applicator body.

3. The cosmetic applicator according to claim 1, wherein the linear core wire stem of the brush member is disposed so as to be substantially flush with left and right side edge portions of the applicator body in a cross section of the applying portion.

4. The cosmetic applicator according to claim 1, wherein a rear end portion of the linear core wire stem of the brush member is swaged and fixed to a hollow shaft tip end portion together with the bearing at the rear end side of the applicator body.

5. The cosmetic applicator according to claim 1, wherein the front end side bearing is formed into a spherical pointed portion having an arched shape in a front view, provided at a position separated forward from a first comb tooth of the plate-shaped comb teeth at a forefront position, and a comb-tooth projection portion narrower in width and shorter in extending length than the first comb tooth is provided between the first comb tooth at the forefront position and the spherical pointed portion.

6. The cosmetic applicator according to claim 5, wherein a front surface of the comb-tooth projection portion is formed into a shape following a front surface of the spherical pointed portion.

7. The cosmetic applicator according claim 1, wherein the plate-shaped comb teeth are narrower in width than a width of the inside of the applicator body and have an acute angle in a front view, and in a substantially lower half of the applicator body, slits arc-shaped in cross section, having widths equal to gaps between the comb teeth, and crossing the body, are formed, and the gaps between the comb teeth communicate with the inside of the applicator body through the slits.

* * * * *